US007415933B2

(12) United States Patent
Sagol

(10) Patent No.: US 7,415,933 B2
(45) Date of Patent: Aug. 26, 2008

(54) COLLAPSIBLE WORKTABLE

(75) Inventor: Sami Sagol, Ramat Hasharon (IL)

(73) Assignee: Keter Plastic Ltd., Herzelyia (IL)

( * ) Notice: Subject to any disclaimer, the term of this patent is extended or adjusted under 35 U.S.C. 154(b) by 280 days.

(21) Appl. No.: 10/900,323

(22) Filed: Jul. 28, 2004

(65) Prior Publication Data

US 2006/0021550 A1 Feb. 2, 2006

(51) Int. Cl.
*A47B 3/00* (2006.01)
*A47B 13/00* (2006.01)
*A47B 91/00* (2006.01)

(52) U.S. Cl. ..... 108/115; 108/153.1; 108/157.1; 108/159.11

(58) Field of Classification Search ..... 108/115, 108/134, 135, 118, 11, 12, 18, 19, 103, 124, 108/127, 166, 167, 169, 171, 159.12, 157.18, 108/69, 157.1, 77, 157.15, 17, 157.16, 174, 108/157.17, 179, 159, 159.11; 144/286.1, 144/287, 286.5; 269/900, 901, 289 R
See application file for complete search history.

(56) References Cited

U.S. PATENT DOCUMENTS

| | | | | | |
|---|---|---|---|---|---|
| 66,813 | A | * | 7/1867 | Doty | 108/115 |
| 318,298 | A | * | 5/1885 | Roberts | 108/124 |
| 432,425 | A | * | 7/1890 | Moan | 108/159 |
| 581,915 | A | * | 5/1897 | Lord | 108/174 |
| 1,259,580 | A | * | 3/1918 | Wurz | 108/124 |
| 1,652,942 | A | * | 12/1927 | Edwin | 108/159 |
| 1,653,296 | A | * | 12/1927 | Kremenek | 108/94 |
| 1,800,685 | A | * | 4/1931 | Griffis | 108/159.11 |
| 1,963,594 | A | * | 6/1934 | Schwabe | 108/159 |
| 2,010,342 | A | * | 8/1935 | Woods | 108/157.18 |
| 2,045,467 | A | * | 6/1936 | Hiser | 108/126 |
| 2,669,117 | A | * | 2/1954 | Fuhrmann | 108/101 |
| 2,997,199 | A | * | 8/1961 | Reachi | 220/23.86 |
| 3,207,093 | A | * | 9/1965 | Block | 108/16 |
| 3,525,492 | A | * | 8/1970 | Kaufman et al. | 248/188.6 |
| 3,669,031 | A | | 6/1972 | Cole | |
| 3,787,018 | A | * | 1/1974 | Nathan | 248/165 |
| 3,966,340 | A | * | 6/1976 | Morris | 403/353 |
| 4,043,278 | A | * | 8/1977 | Kessler et al. | 108/150 |
| 4,102,555 | A | | 7/1978 | Tobolski | |
| 4,315,467 | A | * | 2/1982 | Vanderminden | 108/157.15 |
| 4,415,149 | A | * | 11/1983 | Rees | 269/88 |

(Continued)

FOREIGN PATENT DOCUMENTS

DE 3238151 A1 * 4/1984

(Continued)

*Primary Examiner*—Janet M Wilkens
*Assistant Examiner*—Timothy M Ayers
(74) *Attorney, Agent, or Firm*—Nath Law Group; Jerald L. Meyer; Sung Yeop Chung

(57) ABSTRACT

The invention relates to a worktable including a work-plate mountable on a support structure, the support structure comprising at least two frames, each frame being either an integral frame or comprising two or more frame members, articulated to one another along a vertical axis, and being pivotally displaceable with respect to one another between an open position and a collapsed position, forming, in the open position, a work-plate bearing structure, and being, in the collapsed position, flush with one another and providing a storage space for the work-plate. The work-plate being rigidly attachable to the work-plate bearing structure of the support structure.

15 Claims, 5 Drawing Sheets

U.S. PATENT DOCUMENTS

| | | | | | |
|---|---|---|---|---|---|
| 4,482,119 | A | * | 11/1984 | Zelkowitz et al. | 248/188 |
| 4,676,174 | A | | 6/1987 | Dingeldey | |
| 5,584,254 | A | * | 12/1996 | Williams | 108/118 |
| 5,862,842 | A | * | 1/1999 | You | 144/308 |
| 6,164,413 | A | * | 12/2000 | Sagol | 182/153 |
| 6,286,824 | B1 | * | 9/2001 | Sagol | 269/99 |
| 2002/0105129 | A1 | * | 8/2002 | Levy | 269/45 |
| 2002/0125072 | A1 | * | 9/2002 | Levy | 182/153 |
| 2004/0129186 | A1 | * | 7/2004 | Curiger | 108/157.16 |

FOREIGN PATENT DOCUMENTS

| | | | | |
|---|---|---|---|---|
| DE | 3616146 | A1 | * | 11/1987 |
| EP | 487363 | A1 | * | 5/1992 |
| EP | 493924 | A1 | * | 7/1992 |
| GB | 2059255 | A | * | 4/1981 |

* cited by examiner

COLLAPSIBLE WORKTABLE

FIELD OF THE INVENTION

The present invention is generally in the field of worktables and in particular it is concerned with such a portable and collapsible worktable.

The term "worktable" as used hereinafter in the specification and claims refers also to "work benches", "saw horses", "sawbucks", etc.

BACKGROUND OF THE INVENTION

A myriad of worktables are available on the market and many patents are directed to various such worktables, most of which typically comprise a work surface (work-plate) and a support structure which in many cases one or both is collapsible.

A variety of patents are concerned with different aspects of the support structure and their collapsing/folding while other patents are directed to features of the work surface and different accessories therefor.

U.S. Pat. No. 3,669,031 discloses a collapsible work table which is designed for carrying power tools. In the open position, it comprises a work surface with a means for mounting a tool (such as a power saw), with one set of adjacent legs containing wheels for portability between two proximate locations. In the event that the table needs to be transported a great distance, the table is collapsible.

U.S. Pat. No. 4,102,555 discloses a collapsible, multiple shelf work table. The support structure provided is simple, and allows for economical and sturdy construction.

U.S. Pat. No. 4,676,174 discloses a worktable comprising two collapsible side frame assemblies, two collapsible cross frame assemblies, and a work surface. The side frame and cross frame assemblies are secured in the open position by the use of turnbuckles attached via hooks. The work surface has hooks which are used to secure it to vertically spaced slots which are on a U-shaped member attached to the side frame assembly.

U.S. Pat. No. 6,286,824 discloses a work table supported on a workhorse which is either collapsible or non-collapsible. The work surface consists of a member which can be attached to the top of the workhorse, and side work-plates which are collapsible. They are supported in the open position by support legs. The work surface includes various elements which are useful for receiving various hardware.

It is an object of the present invention to provide a worktable which is easily assembled and erected on a support structure, and can be easily disassembled and collapsed in such a way as to minimize its profile for compact transport and storage.

SUMMARY OF THE INVENTION

According to the present invention there is provided a work-plate mountable on a support structure, the support structure comprising at least two frames, each of the frames may either be an integral frame or comprising two or more frame members, articulated to one another along a vertical axis, and being pivotally displaceable with respect to one another between an open position and a collapsed position, forming, in the open position, a work-plate bearing structure, and being, in the collapsed position, flush with one another and providing a storage space for the work-plate; the work-plate being rigidly attachable to the work-plate bearing structure of the support structure.

The support structure may comprise a vertical post coincident with the vertical axis. The post, according to one particular embodiment, provides an arrangement to which the frames are pivotally hinged thereto. When the post extends from top to bottom, it provides a vertical load-bearing structure for the support frame.

According to one particular embodiment, when the frames are in the collapsed position, the work-plate may be attached to the post for compact transport and storage.

According to a characteristic feature of the invention, the support structure comprises two frames articulated about a vertical axis extending through the midpoint of said frames. The frames form, in the open position, an X-like shaped structure. The support structure may further comprise a vertical post coincident with said vertical axis.

In accordance with a modified embodiment, the frames may be attached to each other along their edges, forming, in the case of two frames, a V-like shaped support frame, or, in the case of more than two frames, a zigzag or a polygonal shape. According to this embodiment, a post may be provided at each point of attachment between two frames.

In accordance with another embodiment, the support structure may comprise three or more frame members articulate to one another about a vertical axis, and being pivotally displaceable with respect to one another between an open position and a closed position.

In accordance with a particular design of the invention, the work-plate may comprise a receiving member which is rigidly attachable to the work-plate bearing structure of the support structure, and at least one side plate which is articulated to the receiving member, providing for the work-plate to be in an open position or a collapsed position. Typically, the work-plate is to be rigidly attached to the work-plate bearing structure of the support structure while the support structure and the work-plate are in their respective open positions. When the support structure is in the collapsed position, the receiving member of the work-plate may remain attached to the work-plate bearing structure of the support structure and the at least one side plate of the work-plate may be collapsed, facilitating temporary storage of the worktable. The work-plate may further comprise at lease one projection extending from the bottom thereof, whilst the work-plate bearing structure comprises at least one receptacle adapted to snuggly receive the projection.

In accordance with a particular embodiment of the invention, the work-plate may be stored in the storage space provided within the support structure in the collapsed position. The thickness of the work-plate is such as to enable the work-plate to be substantially received within the storage space and still remain fully received and flush with the profile of the support structure in the collapsed position. This arrangement has the advantage of reducing the shipping volume of the worktable. It has the further advantage of requiring a smaller space for storage.

In accordance with another modification of the invention, the top portion of the support structure or of the work-plate may comprise one or more longitudinal V-like grooves. In the case of two or more grooves, the grooves are to be axially aligned to facilitate support thereon of a long bar, etc.

In accordance with another design, the support structure comprises at least one anti-slip shoe attached to the bottom portion of each of the at least two frames. The position of each anti-slip shoe may be independently vertically adjustable, facilitating stability of the frames on an uneven floor surface. In particular, each bottom corner of each of the at least two frames is to contain an anti-slip shoe.

The worktable may be used as a base for a board to serve as a job site worktable. Similarly, two such worktables may be used in conjunction with one another as a base for a long board to form a table.

In addition, the worktable may contain any or several of the following features:

- Indicia on the work-plate, typically adjacent to at least one edge of the work-plate, which are spaced in accordance with at least one standard system for linear measurement.
- Openings in the work-plate, useful for receiving and holding a variety of tools and accessories.
- A vice, the vice comprising an adjustable screw manipulable by a handle, a first jaw, and a second jaw facing the first jaw and being displaceable along an axis of said adjustable screw, said screw extending within the work-plate.
- One or more receptacles built into the work-plate, useful for storage of small pieces of hardware, drill bits, etc.
- An arrangement useful for locking the support structure at either an open position or a closed position.
- An arrangement for linking two or more worktables together.

BRIEF DESCRIPTION OF THE DRAWINGS

In order to understand the invention and to see how it may be carried out in practice, some embodiments will now be described, by way of non-limiting examples only, with reference to the accompanying drawings, in which.

DETAILED DESCRIPTION OF THE INVENTION

Figure 1:
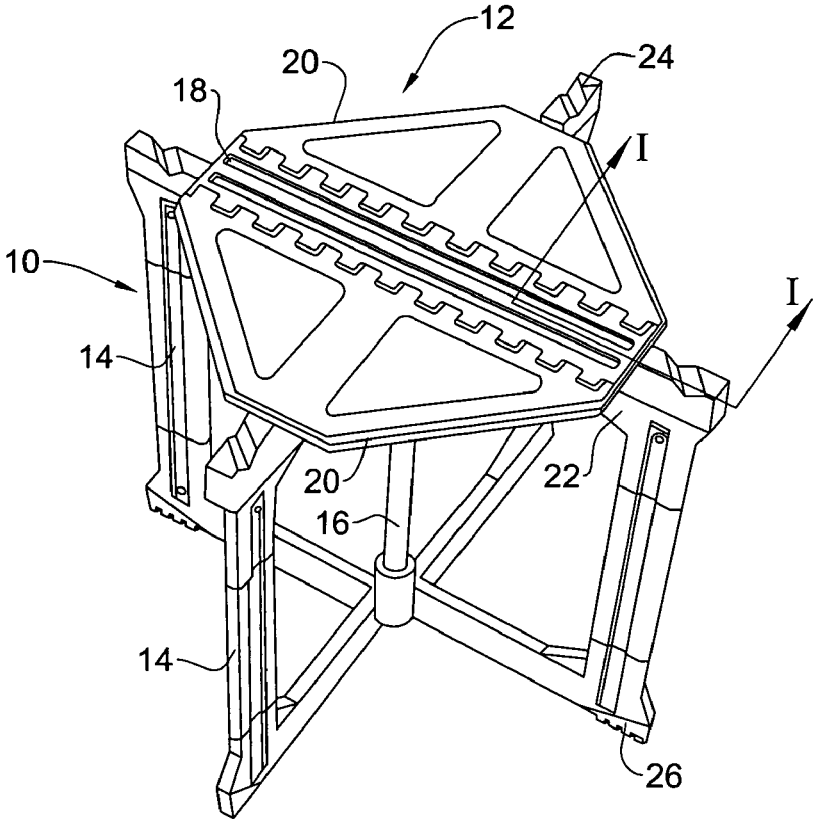
FIG. 1 is a perspective view of an X-like shaped worktable according to the invention, in an open position.
Figure 2:
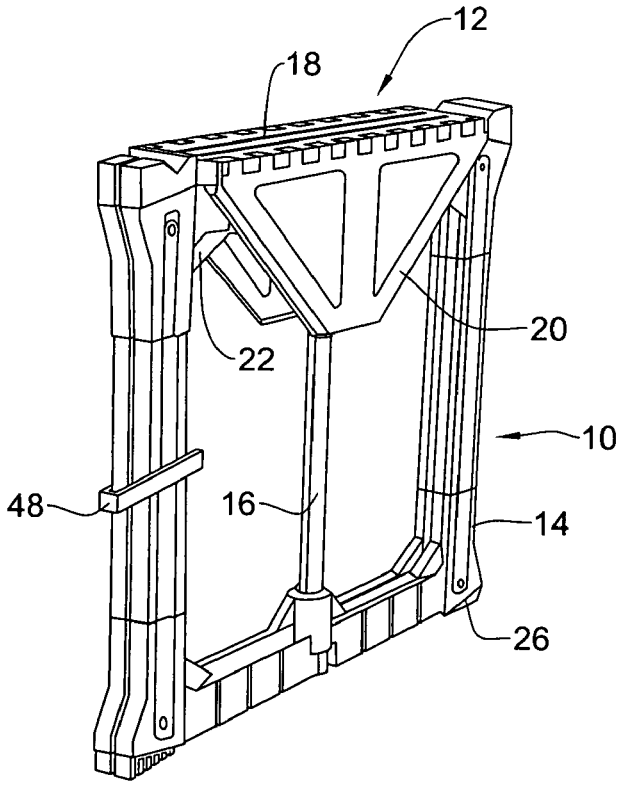
FIG. 2 is a perspective view of the worktable in a collapsed position, with the work-plate articulated to the support structure.
Figure 3:
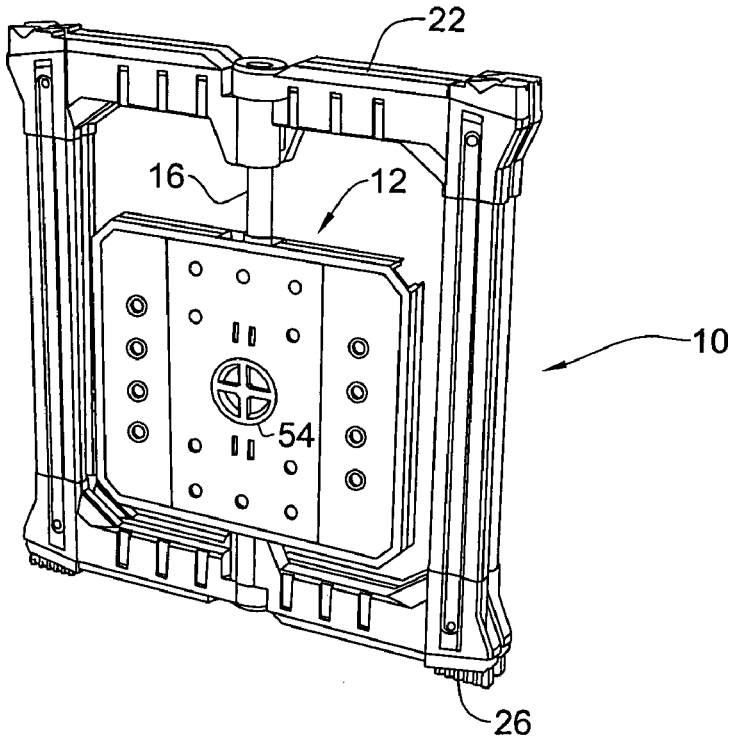
FIG. 3 is a front perspective view of the worktable in its long-term storage position.
Figure 3A:
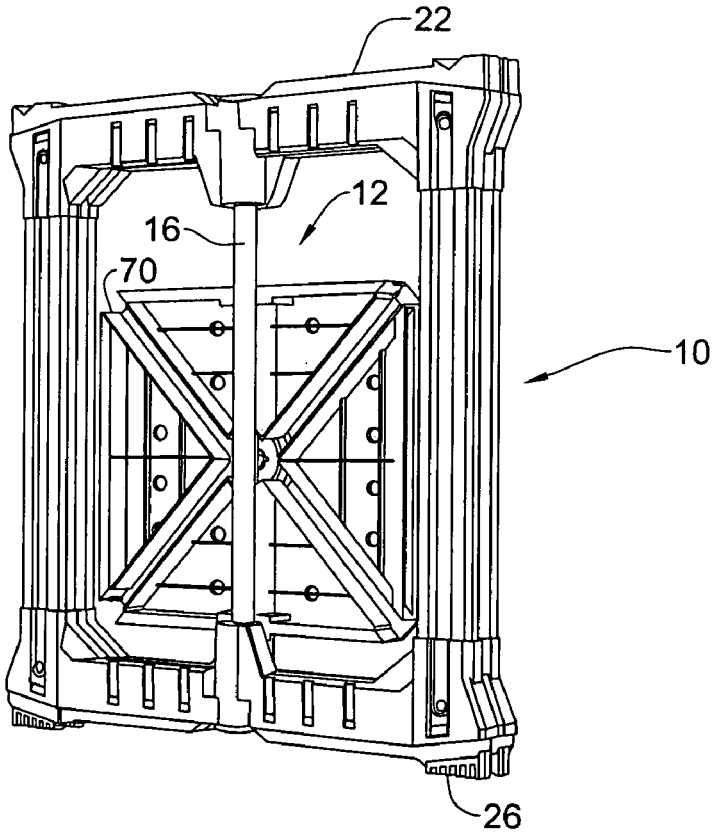
FIG. 3A is a back perspective view of the worktable in its long-term storage position.
Figure 8:
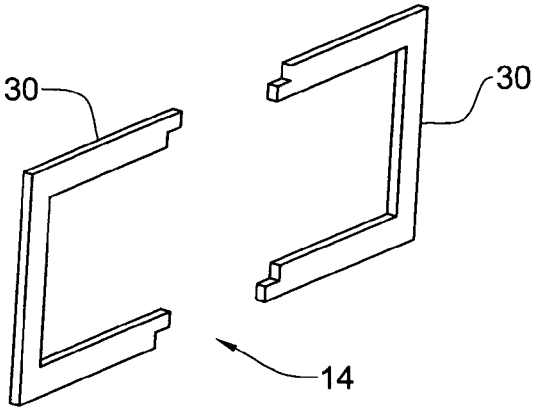
FIG. 8 is an exploded perspective view of a frame comprising two frame members.

The collapsible worktable provided by the present invention includes a support structure 10 (FIG. 1) having a work-plate 12 supported thereon. The support structure 10 comprises at least two frames 14 pivotally articulated to one another along at least one vertical axis between an open position (FIG. 1) and a collapsed position (FIG. 2). Each frame 14 may be an integral frame or comprise two frame members 30 (FIG. 8). The support structure 10 shall provide, in the open position, a storage space for the work-plate 12 (FIG. 3). The thickness of the work-plate 12 shall be such as to enable it to be received within the storage space and remain fully received and flush with the support structure 10 in the collapsed position. In one embodiment, at least one optional vertical post 16 may be present, generally coincident with the at least one axis, providing a vertical support structure to the support structure. When the support structure 10 is in the collapsed position, the work-plate 12 may be rigidly attached to the post 16.

Figure 1A:
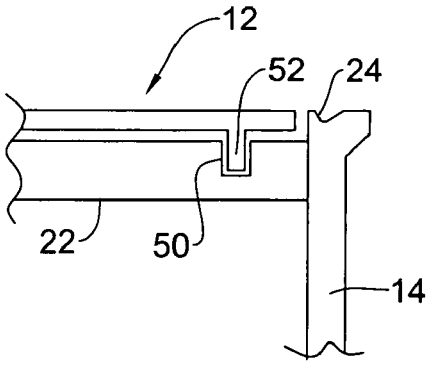
FIG. 1A is a partial section taken along line I-I.

According to this embodiment, the work-plate bearing structure 22 of the support structure 10 may comprise at least one receptacle 50 (FIG. 1A). The work-plate 12 may comprise at least one projection 52 extending from the bottom thereof, which snuggly fits into said at least one receptacle 50.

Figure 12:
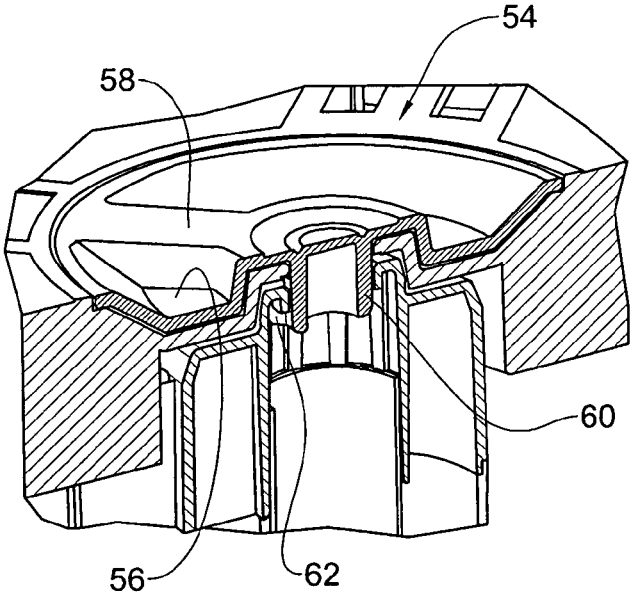
FIG. 12 is a perspective sectional view of a locking disk.
Figure 11:
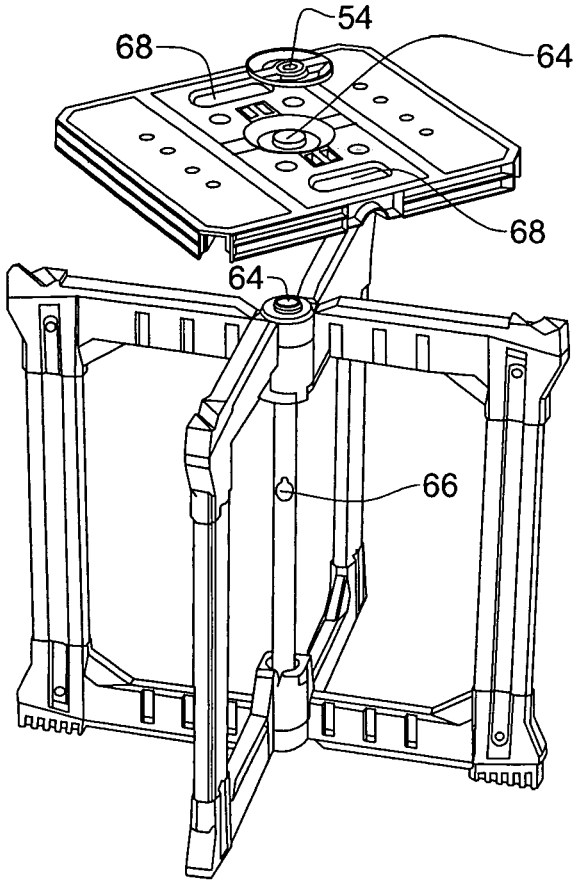
FIG. 11 is an exploded perspective view of one embodiment of the worktable in an open position.
Figure 13:
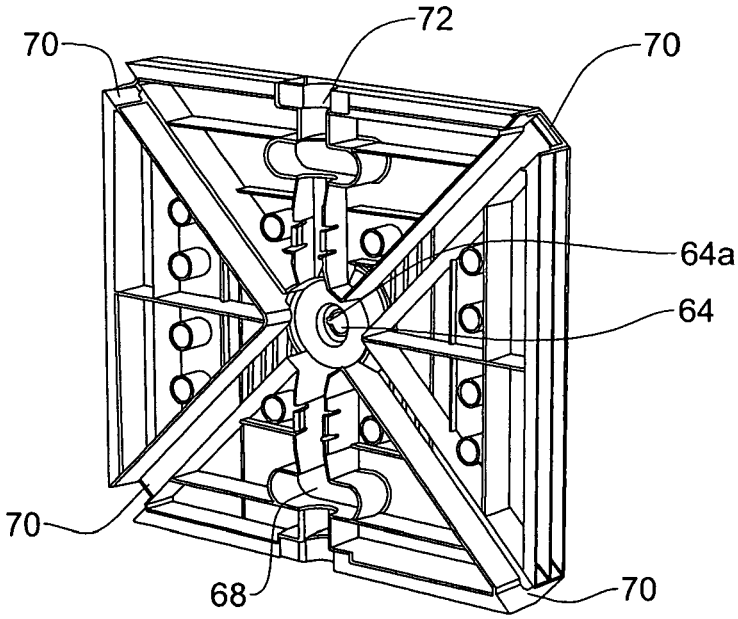
FIG. 13 is a perspective bottom view of the work-plate according to a particular embodiment.

The worktable may comprise a locking disk 54 (FIG. 11), comprising an upper portion, which comprises a structure to facilitate grasping. This structure, in one particular embodiment, comprises two arc-like depressions 56, resulting in two portions 58 raised relative to the bottom of the depressions 56. The locking disk 54 further comprises a downward circular projection 60, having, at its end, and nub-like structure 62. In this embodiment (FIGS. 11 & 12), the locking disk 54 may be secured to the work-plate bearing structure 22 and the work-plate 12 by a bayonet connection as follows: central portions of the work-plate bearing structure 22 and the work-plate 12 each comprise an aperture 64 formed to receive the projection 60 with the nub-like structure 62. The apertures 64, for example as illustrated in FIG. 13, each comprise a groove 64*a* to receive therein the nub, and are formed so that when the locking disk 54 is inserted thereto so that the nub-like structure 62 completely passes through, the locking disk 54 can be rotated to prohibit its removal. According to another modification of the invention (FIG. 11), the post 16 comprises a similar aperture 66. It is located at a spot on the post 16 so that the work-plate 12 can be secured to it with the locking disk 54 in the long-term storage position.

According to this embodiment, the work-plate 12 comprises a receiving member 18 which is rigidly attachable to a top portion 22 of the support structure 10. At least one side plate 20 is articulated to the receiving member 18 between an open position (FIG. 1) and a collapsed position (FIG. 2). In the open position, the top surfaces of the receiving member 18 and the at least one side plate 20 are flush with each other. The receiving member 18 is of a width to allow the at least one side plate 20 to be in a fully collapsed position, i.e. collapsed in a downward direction generally orthogonal to the receiving member, providing a space adjacent the at least one work plate 20 for the support structure 10 to be in the collapsed position while the receiving member 18 remains rigidly attached (FIG. 2).

In the normal course of operation, both the support structure 10 and the work-plate 12 are in the open positions (FIG.

1). In this operative position, the top surfaces of the support structure 10 are substantially flush with the top surface of the work-plate 12.

Figure 4:
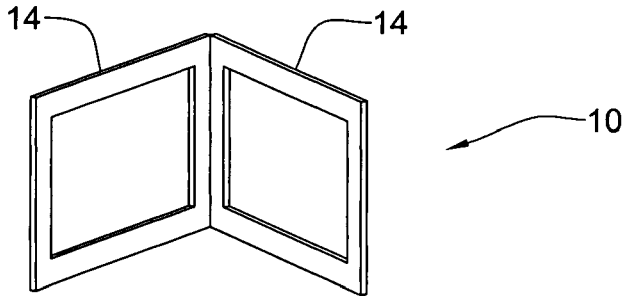
FIG. 4 is a perspective view of a modification of the invention, illustrating the support structure in the open position, wherein the frames are articulated at their ends, forming a V-formation.
Figure 5:
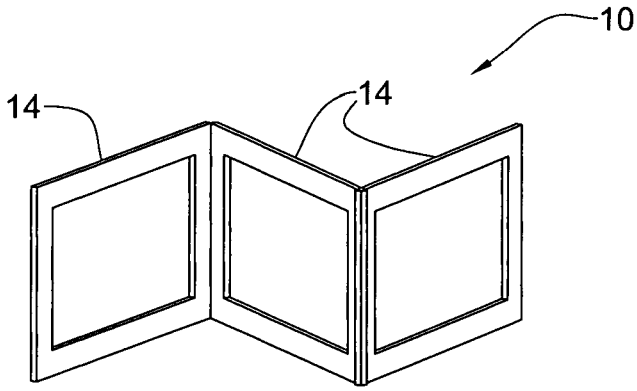
FIG. 5 is a perspective view of a modification of the invention, illustrating the support structure in the open position, wherein the frames are articulated at the ends, forming a zigzag formation.
Figure 6:
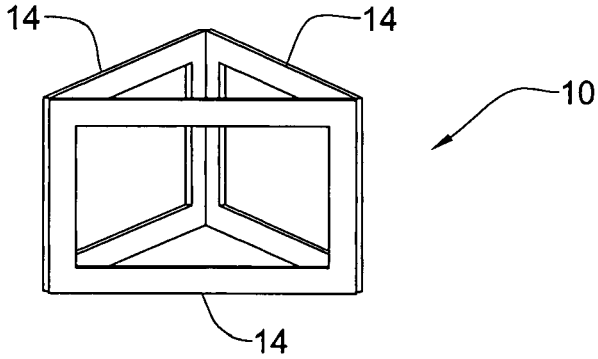
FIG. 6 is a perspective view of a modification of the invention, illustrating the support structure in the open position, wherein the frames are articulated at the ends, forming a closed polygonal formation.
Figure 7:
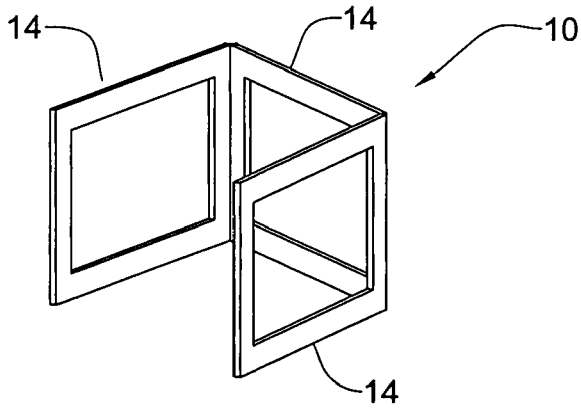
FIG. 7 is a perspective view of a modification of the invention, illustrating the support structure in the open position, wherein the frames are articulated at the ends, forming an open polygonal formation.

According to another embodiment of the invention, the at least two frames 14 of the support frame 10 are articulated to each other at their ends. (FIGS. 4,5, 6, & 7). The frames 14 may be opened to a V-shape, in the case of two frames (FIG. 4). In the case of more than two frames 14, they may be open to either a zigzag formation (FIG. 5), a closed polygonal formation (FIG. 6), or an open polygonal formation (FIG. 7).

Figure 9:
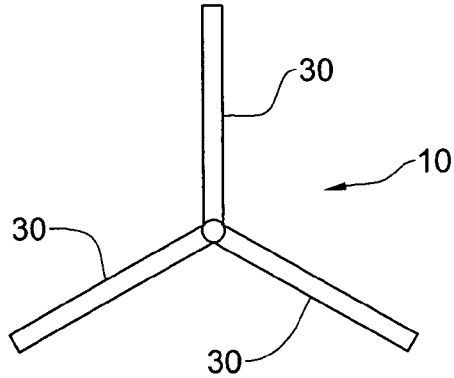
FIG. 9 is a plan view of a support structure in the open position comprising three frame members.

According to another embodiment of the invention (FIG. 9), the support structure comprises at least three frame assemblies 30 articulated about a vertical axis. The support structure forms, in the open position, a hub and spoke formation.

The top portion 22 of the at least two frames 14 of the support structure 10 or of the work-plate 12 comprises one or more longitudinal V-like shaped recesses 24. In the case of two or more grooves, the grooves are axially aligned to facilitate support thereon of a long bar, etc.

The bottom portion of the at least two frames 14 of the support structure 10 contains at least one anti-slip shoe 26, particularly at each bottom corner of the frame 12. The position of each anti-slip shoe may be independently vertically adjustable, facilitating stability of the frames on an uneven floor surface (FIG. 1).

Figure 10:
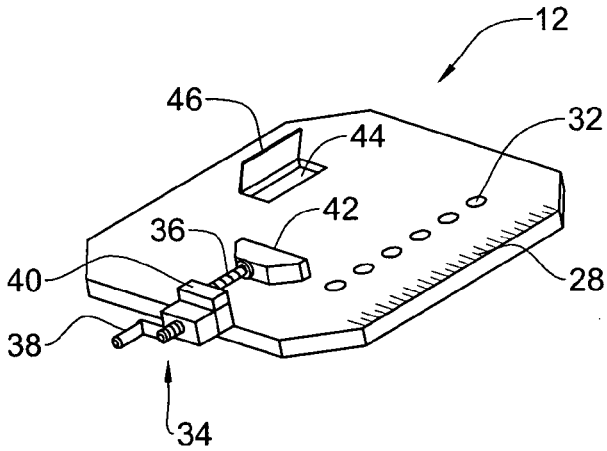
FIG. 10 is a perspective view of the work-plate, wherein several optional features of the worktable are shown.

In addition, the work-plate 12 may contain indicia 28, typically adjacent at least one edge of the work-plate 12, which are spaced in accordance with at least one standard system for linear measurement (FIG. 10).

The work-plate 12 may further comprise at least one opening 32 passing vertically through the work-plate, useful for receiving and holding a variety of hand tools (FIG. 10).

The work-plate 12 may further comprise a vise 34 comprising an adjustable screw 36 manipulable by a handle 38, a first jaw 40, and a second jaw 42 facing the first jaw and being displaceable along an axis of said screw, said screw extending into the work-plate 12 (FIG. 10).

The work-plate 12 may further comprise one or more recessed storage compartments 44, useful for storing small pieces of hardware, drill bits, etc., with a closable lid 46, such that, in a closed position, the lid is flush with the surface of the work-plate 12 (FIG. 10).

The work-plate may further comprise handles 68 (FIG. 13) useful for carrying the worktable in its long-term storage position.

The work-plate may comprise, on its lower portion, channel-like structures 70 (FIG. 13) suitable for receiving the work-plate receiving structure 22 of the support structure 10. It may further comprise a channel 72 suitable for receiving to post 16 in the long-term storage position.

The worktable may further comprise an arrangement 48 useful for locking the support structure into either an open position or a closed position (FIG. 2).

The invention claimed is:

1. A collapsible worktable comprising:

(i) a support structure, having at least two frames articulated about a vertical axis; said frames being pivotally displaceable with respect to one another between a collapsed position and an open position and wherein a top portion of said frames forms, in the open position thereof, a work-plate bearing structure;

(ii) a work-plate, rigidly attachable over said work-plate bearing structure;

(iii) a post coincident with said axis; and (iv) a locking disk rotatable with respect to the work-plate and having a projection with a nub structure constituting a quick-lock fastening structure;

said at least two frames, in the collapsed position of the support structure, being substantially flush with one another and providing a space for storage therewithin of the work-plate; said work-plate and work-plate bearing structure each comprising an aperture coincident with said axis so formed as to cooperate with said nub structure for securing of the work-plate over said work-plate bearing structure in its open position; said post comprising an second aperture so formed on a side of the post as to cooperate, together with the aperture of the work-plate, with said nub structure for securing of the work-plate to the post within said space in the collapsed position of the support structure.

2. The worktable according to claim 1, wherein the post extends fully from the top portion of said frames to a bottom portion of said frames.

3. The worktable according to claim 1, whereas the support structure comprises two frames articulated about a vertical axis approximately intersecting the midpoint of said frames; said frames forming, in the open position, generally X-shaped structure; the support structure further comprising said post.

4. The worktable according to claim 1, further comprising at least one anti-slip shoe attached to the bottom portion of each of the at least two frames, said at least one anti-slip shoe being independently vertically adjustable.

5. The worktable according to claim 1, further comprising at least two longitudinal generally V-shaped recess in the top portion of at support structure, said at least two longitudinal generally V-shaped shaped recess being axially aligned when the support structure is in the open position.

6. The worktable according to claim 1, wherein the work-plate further comprises indicia, typically adjacent to at least one edge of said work-plate, said indicia being calibrated according to at least one standard method of linear measurement.

7. The worktable according to claim 1, further comprising a vice, the vice comprising an adjustable screw manipulable by a handle, a first jaw, and a second jaw facing the first jaw and being displaceable along an axis of said adjustable screw, said screw extending into the work-plate.

8. The worktable according to claim 1, wherein the work-plate further comprises a plurality of openings passing vertically through, useful for receiving and holding a variety of hand tools.

9. The worktable according to claim 1, wherein the work-plate further comprises a recessed storage compartment with a closeable lid, said lid, in a closed position, being generally flush with the top surface of the work-plate.

10. The worktable according to claim 1, further comprising a locking arrangement.

11. The worktable according to claim 1, wherein:

(i) said locking disk comprises an upper portion having a structure to facilitate grasping;

(ii) said projection being a downward facing circular projection; and (iii) each of said apertures being further formed of a size so as to receive said projection;

wherein the projection, nub structure, and aperture cooperate to secure the locking disk to the worktable by a bayonet connection.

12. The worktable according to claim 11, wherein the work-plate further comprises a depression to receive the locking disk, wherein said locking disk is flush with the top surface of the work-plate in a locked position.

13. The worktable according to claim 11, wherein the work-plate further comprises at least one aperture formed to be useful as a handle when the work-plate is attached to the post.

14. The worktable according to claim 1, the work-plate further comprising channel structures to receive the work-plate bearing structure in the open position.

15. The worktable according to claim 1, the work-plate further comprising a channel structure to receive said post when the work-plate is fully received within the support structure in the collapsed position.

* * * * *